US009234532B2

(12) United States Patent
Vanderlaan et al.

(10) Patent No.: US 9,234,532 B2
(45) Date of Patent: Jan. 12, 2016

(54) VELOCITY CONTROL OF UNBALANCED HYDRAULIC ACTUATOR SUBJECTED TO OVER-CENTER LOAD CONDITIONS

(75) Inventors: Dale Vanderlaan, Kalamazoo, MI (US); Ralf Gomm, Cleveland, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 1350 days.

(21) Appl. No.: 13/060,452

(22) PCT Filed: Sep. 3, 2009

(86) PCT No.: PCT/US2009/055807

§ 371 (c)(1),
(2), (4) Date: May 17, 2011

(87) PCT Pub. No.: WO2010/028100

PCT Pub. Date: Mar. 11, 2010

(65) Prior Publication Data

US 2011/0209471 A1 Sep. 1, 2011

Related U.S. Application Data

(60) Provisional application No. 61/093,757, filed on Sep. 3, 2008.

(51) Int. Cl.
*F15B 7/00* (2006.01)

(52) U.S. Cl.
CPC ..... *F15B 7/006* (2013.01); *F15B 2211/20515* (2013.01); *F15B 2211/20561* (2013.01);
(Continued)

(58) Field of Classification Search
CPC ..... F15B 7/006; F15B 2211/20515; F15B 2211/20561; F15B 2211/785; F15B 2211/6336; F15B 2211/761; F15B 2211/613
USPC ..... 60/431, 445, 446, 449, 459, 463, 475, 60/476; 91/358 R, 361, 391, 392
See application file for complete search history.

(56) References Cited

U.S. PATENT DOCUMENTS 3,744,243 A 7/1973 Faisandier
3,791,212 A 2/1974 Blackburn et al.
(Continued)

FOREIGN PATENT DOCUMENTS

EP 1892413 A1 2/2008
WO 2008057177 A2 5/2008
WO 2008107671 A1 9/2008

OTHER PUBLICATIONS

Alan L. Hitchcox, "Unconventional HPU Opens New Opportunities" Hydraulics Pneumatics, Applications XP-001516103, Jul. 2008, pp. 14-15.

*Primary Examiner* — Edward Look
*Assistant Examiner* — Michael Quandt
(74) *Attorney, Agent, or Firm* — Renner, Otto, Boisselle & Sklar, LLP

(57) ABSTRACT

An electro-hydraulic actuation system (901) includes an unbalanced hydraulic actuator (902) capable of motion in retraction and extension directions during movement of a load (904). A pump (204) provides a flow of fluid to the actuator. A displacement of the pump controls a velocity of the actuator during motion in the retraction and extension directions. An electric motor (202) drives the pump. Speed and direction of the electric motor affects the displacement of the pump. A controller (802) controls the speed and direction of the electric motor. A feedback device (228,248) is operable for sensing a system condition and for providing a feedback signal indicative of the sensed system condition to the controller. The controller is responsive to the feedback signal for determining an occurrence of an over-center load condition and for modifying the speed of the electric motor in response to the occurrence in an attempt to maintain the velocity of the actuator.

18 Claims, 8 Drawing Sheets

(52) U.S. Cl.
CPC ... *F15B2211/613* (2013.01); *F15B 2211/6336* (2013.01); *F15B 2211/761* (2013.01); *F15B 2211/785* (2013.01)

(56) References Cited

U.S. PATENT DOCUMENTS

| | | | | | |
|---|---|---|---|---|---|
| 4,762,195 | A | | 8/1988 | McBurnett | |
| 4,815,289 | A | | 3/1989 | Williams | |
| 5,064,351 | A | | 11/1991 | Hamey et al. | |
| 5,179,836 | A | * | 1/1993 | Dantlgraber | 60/430 |
| 5,557,154 | A | | 9/1996 | Erhart | |
| 5,701,795 | A | * | 12/1997 | Friedrichsen | 91/446 |
| 5,778,671 | A | * | 7/1998 | Bloomquist et al. | 60/456 |
| 5,904,126 | A | | 5/1999 | McKay et al. | |
| 6,135,724 | A | | 10/2000 | Yoder et al. | |
| 6,375,433 | B1 | | 4/2002 | Du et al. | |
| 6,498,973 | B2 | | 12/2002 | Dix et al. | |
| 6,575,076 | B1 | | 6/2003 | Achten | |
| 6,739,129 | B2 | | 5/2004 | Heusser et al. | |
| 6,748,739 | B1 | | 6/2004 | Hirano et al. | |
| 6,796,120 | B2 | | 9/2004 | Franchet et al. | |
| 6,851,207 | B2 | | 2/2005 | Yoshimatsu | |
| 6,962,050 | B2 | * | 11/2005 | Hiraki et al. | 60/414 |
| 6,979,185 | B2 | | 12/2005 | Kaempe | |
| 7,048,515 | B2 | | 5/2006 | Shimomura et al. | |
| 7,281,372 | B2 | | 10/2007 | Sakai et al. | |
| 7,478,489 | B2 | * | 1/2009 | Anderson et al. | 37/348 |
| 2005/0008498 | A1 | | 1/2005 | Zumbusch | |
| 2005/0084387 | A1 | | 4/2005 | Klocke | |
| 2006/0198737 | A1 | | 9/2006 | Matsui et al. | |
| 2007/0041849 | A1 | | 2/2007 | Allen | |
| 2007/0166168 | A1 | | 7/2007 | Vigholm et al. | |
| 2008/0080985 | A1 | | 4/2008 | Gray et al. | |
| 2008/0190104 | A1 | | 8/2008 | Bresie | |
| 2009/0165450 | A1 | | 7/2009 | Chemey et al. | |

* cited by examiner

VELOCITY CONTROL OF UNBALANCED HYDRAULIC ACTUATOR SUBJECTED TO OVER-CENTER LOAD CONDITIONS

CROSS REFERENCE TO RELATED APPLICATIONS

The present application claims the benefit of the filing date of U.S. Provisional Patent Application Ser. No. 61/093,757, filed on Sep. 3, 2008, the disclosure of which is incorporated herein by reference in its entirety.

TECHNICAL FIELD

The present invention relates generally to a hydraulic actuation system for extending and retracting at least one unbalanced hydraulic actuator. More particularly, the present invention relates to velocity control of an unbalanced hydraulic actuator that is subjected to over-center load conditions.

BACKGROUND

Hydraulic actuators in many machines are subjected to varying loads. The loads may be overrunning loads or resistive loads. An overrunning load is a load that acts in the same direction as the motion of the actuator. Examples of overrunning loads include lowering a wheel loader boom or lowering an excavator boom, each with gravity assistance. A resistive load is a load that acts in the opposite direction as the motion of the actuator. Examples of resistive loads include raising a wheel loader boom or raising an excavator boom, each against the force of gravity. In certain applications, hydraulic actuators can be subjected to both an overrunning load and a resistive load in the same extend or retract stroke. As an example, when a wheel loader bucket that is curled in is given a command to curl out (generally, a retraction of the actuator), the motion may begin with a resistive load applied to the actuator and, at some point in the stroke, typically due to the force of gravity, the load on the actuator becomes an overrunning load. The transition between the resistive load and the overrunning load without a change in the direction of motion is referred to herein as an "over-center load condition." An over-center load condition may occur during a transition from a resistive load to an overrunning load and during a transition from an overrunning load to a resistive load.

It is desirable that an over-center load condition not affect the velocity of retraction or extension of the actuator. Such velocity control is particularly difficult when the hydraulic actuator is an unbalanced actuator of an electro-hydraulic actuation (EHA) system. An unbalanced actuator has unequal cross-sectional areas on opposite sides of the piston, generally as a result of the rod being attached to only one side of the piston. An EHA system is a system in which a reversible, variable speed electric motor is connected to a hydraulic pump, generally fixed displacement, for providing fluid to an actuator for controlling motion of the actuator.

SUMMARY

An electro-hydraulic actuation system includes an unbalanced hydraulic actuator capable of motion in retraction and extension directions during movement of a load. A pump provides a flow of fluid to the actuator. A displacement of the pump controls a velocity of the actuator during motion in the retraction and extension directions. An electric motor drives the pump. Speed and direction of the electric motor affects the displacement of the pump. A controller controls the speed and direction of the electric motor. A feedback device is operable for sensing a system condition and for providing a feedback signal indicative of the sensed system condition to the controller. The controller is responsive to the feedback signal for determining an occurrence of an over-center load condition and for modifying the speed of the electric motor in response to the occurrence in an attempt to maintain the velocity of the actuator.

According to one embodiment, the feedback device is adapted for sensing a position or velocity of a piston relative to a housing of the actuator.

In another embodiment, the feedback device is a sensor for sensing a pressure differential between the chambers of the actuator. The sensor may be a sensor for sensing a position of a shuttle valve associated with a charge pump system with the shuttle valve switching positions in response to the pressure differential.

In yet another embodiment, the feedback device is adapted to sense the current and direction of rotation of the electric motor.

BRIEF DESCRIPTION OF THE DRAWINGS

Embodiments of this invention will now be described in further detail with reference to the accompanying drawings, in which.

DETAILED DESCRIPTION

Figure 1:
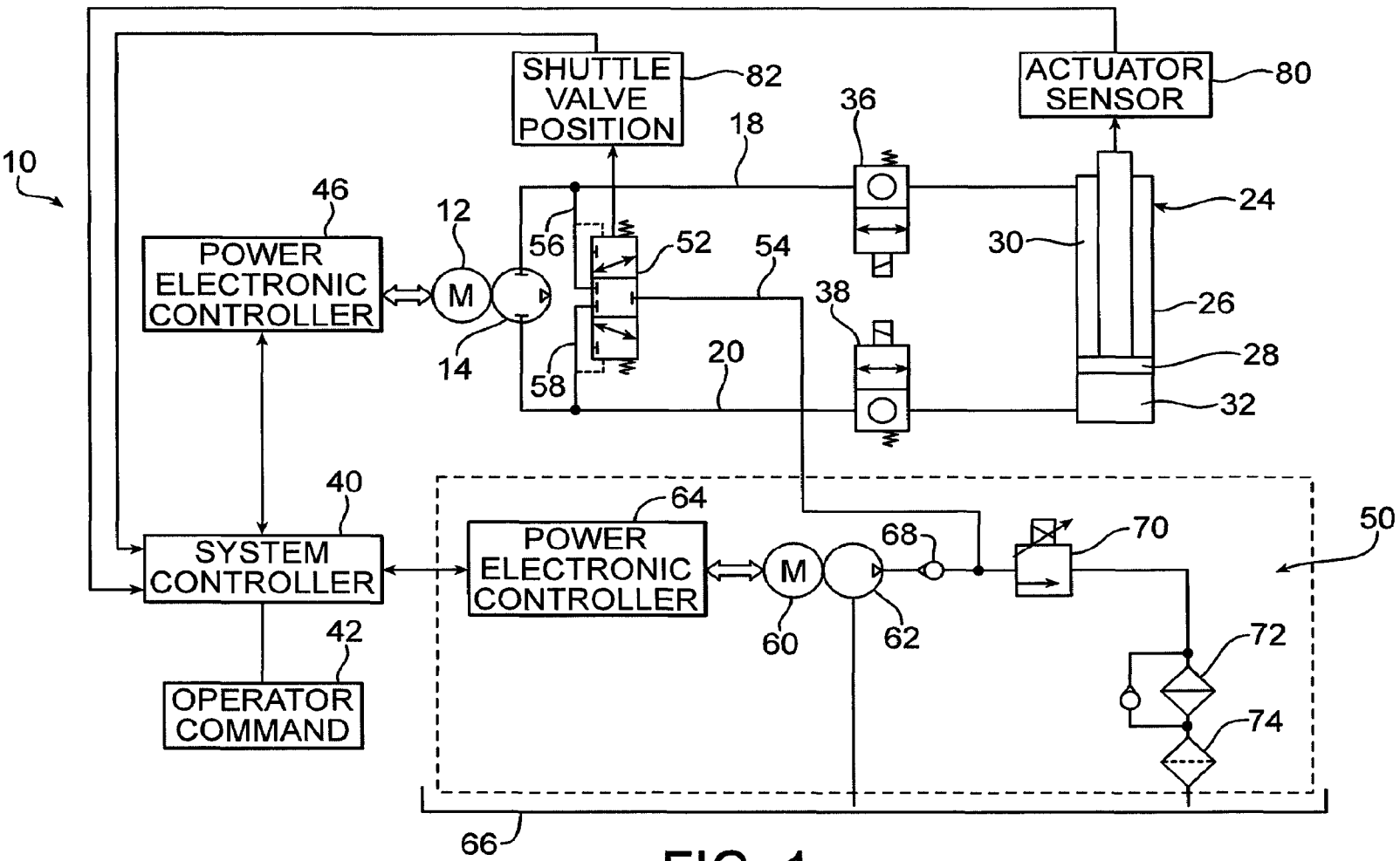
FIG. 1 illustrates an exemplary embodiment of a system constructed in accordance with the present invention and incorporating multiple feedback devices.

FIG. 1 illustrates an exemplary embodiment of a system 10 constructed in accordance with the present invention. The system 10 includes an electric motor 12 that is operatively coupled to and drives a hydraulic pump 14. The electric motor 12 is a reversible, variable speed electric motor. In the embodiment of FIG. 1, the hydraulic pump 14 is a fixed displacement two port pump. Alternatively, other types of pumps, such as a variable displacement pump or a three port fixed displacement pump, may be used. When driven in a first direction by the electric motor 12, the hydraulic pump 14 of FIG. 1 provides fluid into conduit 18. When driven in a second direction opposite the first direction, the hydraulic pump 14 provides fluid into conduit 20.

The system 10 also includes a hydraulic actuator 24. The actuator 24 of FIG. 1 is an unbalanced hydraulic actuator having a housing 26, a piston/rod assembly 28, a rod side chamber 30, and a head side chamber 32. The hydraulic actuator 24 of FIG. 1 is unbalanced due to the cross-sectional area of the head side chamber 32 being greater than the cross-sectional area of the rod side chamber 30. When the actuator 24 is extended, more fluid is needed to fill the head side chamber 32 of the actuator 24 than is being discharged from the rod side chamber 30. Conversely, when the actuator 24 is retracted, less fluid is needed to fill the rod side chamber 30 than is being discharged from the head side chamber 32. Conduit 18 extends between the pump 14 and the rod side chamber 30 and, conduit 20 extends between the pump 14 and the head side chamber 32. Each conduit 18 and 20 has an associated load holding valve 36 and 38, respectively. The load holding valves 36 and 38 are two position, solenoid operated valves controlled by a system controller 40. The load holding valves 36 and 38 are used to prevent fluid flow out of the rod side chamber 30 and out of the head side chamber 32, respectively, when no motion of the actuator 24 is desired. This allows the electric motor 12 to remain in a low energy state while the holding valves 36 and 38 maintain pressure in the actuator 24.

The system controller 40 receives input (or command) signals from an operator input device 42, such as joysticks or similar devices. The system controller 40 converts the input signals into desired velocity command signals that are sent to a power electronic controller 46. The power electric controller 46 may be a separate device from the system controller 40 or may form a portion of the system controller. The power electric controller 46 is responsive to the desired velocity command signals for the powering the electric motor 12.

The system 10 of FIG. 1 also includes a charge pump system 50. The charge pump system 50 is in communication with conduits 18 and 20 via an associated shuttle valve 52 and associated conduits 54, 56 and 58. The shuttle valve 52 automatically changes position in response to the pressure differential between the conduits 18 and 20 to connect the low pressure conduit to the charge pump system 50. The charge pump system 50 includes an electric motor 60 that is operatively coupled to a fixed displacement hydraulic charge pump 62. The electric motor 60 receives power from an associated power electronic controller 64, which may be a separate device from controllers 40 and 46 or may be a common device as one or both of the controllers. Upon receiving electric power, the electric motor 60 drives the pump 62 to draw fluid from a reservoir 66 and to provide the fluid through a check valve 68 and into conduit 54 that is connected to the shuttle valve 52. A flow control valve 70, which is controlled by the system controller 40, controls the flow of fluid through the conduit 54. When the flow control valve 70 is closed, as illustrated in FIG. 1, the flow of fluid from the charge pump 62 is directed into the conduit 54 and toward the shuttle valve 52. When the flow control valve 70 is open, the flow of fluid from the charge pump 62, when operating, and the flow of fluid through the conduit 54 from the shuttle valve 52 are directed to the reservoir 66 via an oil cooler 72 and filter 74. The charge pump system 50 functions to provide fluid to the inlet side of the pump 14 to prevent cavitation and to make up for any differential in fluid resulting from the actuator 24 being unbalanced.

FIG. 1 also illustrates an actuator position sensing device 80 and a shuttle valve position sensing device 82. The actuator position sensing device 80 is adapted to sense a position of the piston of the piston/rod assembly 28 relative to the housing 26 of the actuator 24 and to provide feedback signals indicative of the sensed actuator position to the system controller 40. In an alternate embodiment, a device adapted to sense a velocity of the piston relative to the housing 26 of the actuator 24 and to provide feedback signals indicative of the sensed actuator velocity to the system controller 40 may be used in place of the actuator position sensing device 80. The shuttle valve position sensing device 82 is adapted to sense a position of the shuttle valve 52 and to provide feedback signals indicative of the sensed shuttle valve position to the system controller 40.

With reference to the actuator of FIG. 1, a velocity of the actuator 24 (i.e., the velocity at which the piston moves relative to the housing 26) is a function of the rate of change in volume of the chamber 30 or 32 having the highest pressure. The rate of change in volume is a function of the displacement of the pump 14 and the cross-sectional area of the respective chamber 30 or 32. When an actuator 24 is unbalanced, the cross-sectional area of the rod side chamber 30 differs from the cross-sectional area of the head side chamber 32. Thus, for the same displacement of the pump 14, the rate of change in volume of the head side chamber 32, which has the larger cross-sectional area, is less than the rate of change in volume of the rod side chamber 30. As a result, for the same displacement, the velocity of the actuator 24 is lower when the head side chamber 32 is the high pressure chamber than when the rod side chamber 30 is the high pressure chamber. For example, when the cross-sectional area of the head side chamber 32 is twice that of the rod side chamber 30, for the same displacement of the pump 14, the velocity of the actuator 24 when the head side chamber 32 is the high pressure chamber is one-half the velocity of the actuator 24 when the rod side chamber 30 is the high pressure chamber. Switch of the high pressure chamber from the rod side chamber 30 to the head side chamber 32 or alternatively, from the head side chamber 32 to the rod side chamber 30, as a result of an over-center load condition results in a change in velocity that is a function of the ratio of the cross-sectional areas of the chambers 30 and 32.

Figure 2A:
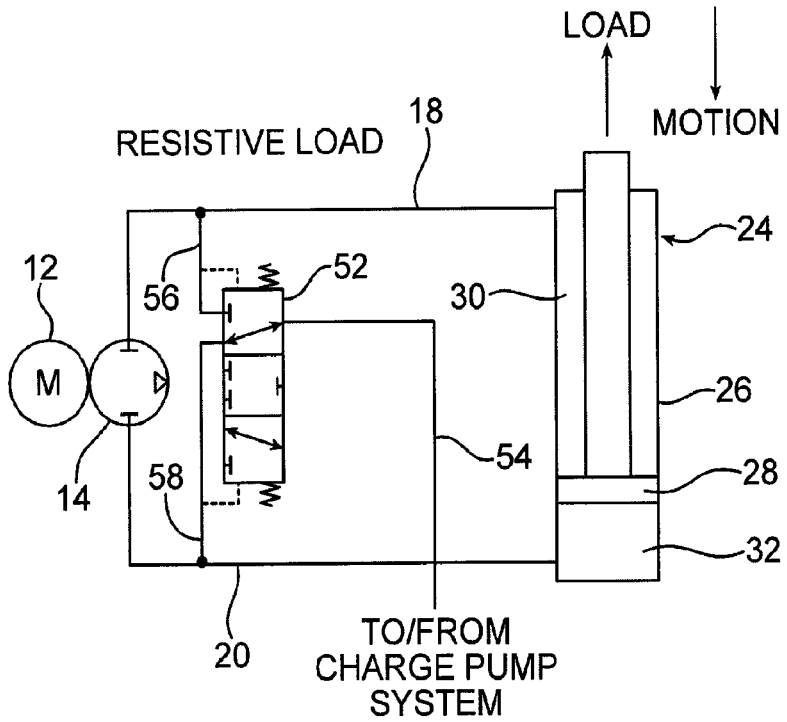
FIG. 2(*a*) illustrates a portion of the system of FIG. 1 with a shuttle valve in a first position and, FIG. 2(*b*) illustrates the portion of the system of FIG. 1 with the shuttle valve in a second position.
Figure 2B:
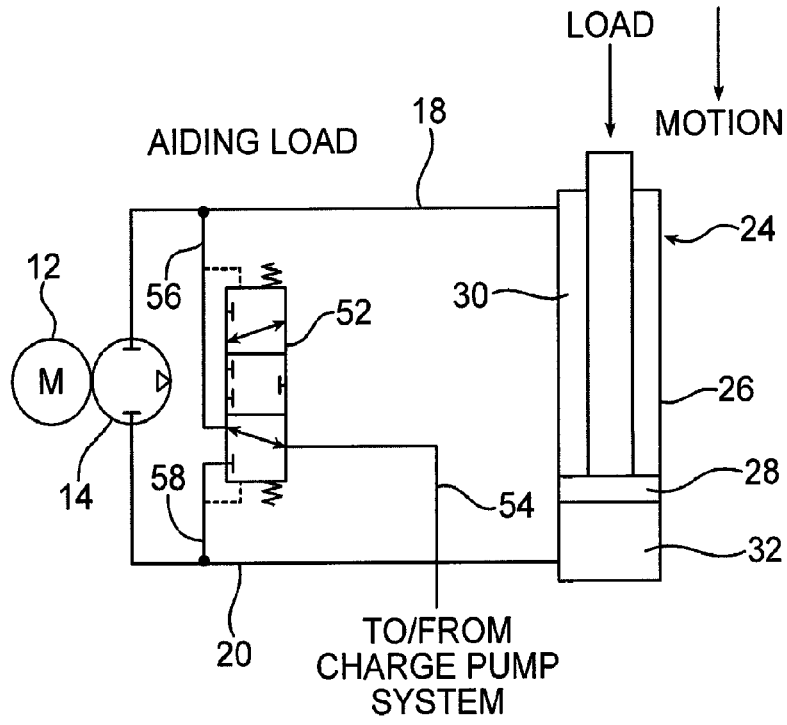

FIG. 2(*a*) illustrates a portion of the system 10 of FIG. 1 with the actuator 24 experiencing a resistive load and with a motion of the actuator 24 in a retraction direction. Thus, the load is directed opposite the direction of motion. In this particular example, the rod side chamber 30 and associated conduit 18 is at a pressure that is higher than the pressure of the head side chamber 32 and associated conduit 20 (the rod side chamber 30 is the high pressure chamber). To continue motion of the actuator 24 in the retraction direction, fluid is provided from the pump 14 via conduit 18 to the rod side chamber 30 to increase the volume of the rod side chamber. The displacement of the pump 14 controls the velocity of the actuator 24.

When an over-center load condition occurs, the direction of motion remains the same (e.g., in the retraction direction) but the direction of the load changes. FIG. 2(*b*) illustrates the portion of the system 10 of FIG. 2(*a*) after the occurrence of an over-center load condition. As shown in FIG. 2(*b*), the motion of the actuator 24 remains in the retraction direction while the load is now directed in the same direction as the motion and opposite the direction illustrated in FIG. 2(*a*). When the load shifts direction at the occurrence of the over-center load condition, the head side chamber 32 and associated conduit 20 suddenly have a pressure that is higher than the pressure of the rod side chamber 30 and associated conduit 18 (the head side chamber is now the high pressure chamber). As a result, the pump 14 acts as a hydraulic motor and, the displacement of the pump 14 controls the rate of flow out the head side chamber 32. As the head side chamber 32 has a larger cross-sectional area than the rod side chamber 30, the displacement of the pump 14 must be increased to maintain the velocity of the actuator 24 consistent with that experienced prior to the over-center load condition.

Consider, for example, the situation in which the head side chamber 32 has a cross-sectional area that is two times the cross-sectional area of the rod side chamber 30. In the scenario illustrated in FIG. 2(*a*), the displacement of the pump 14 is being provided to the rod side chamber 30 (the high pressure chamber) to force the piston/rod assembly 28 in the retraction direction. When the over-center load condition occurs, the head side chamber 32 becomes the high pressure chamber and the hydraulic pump 14, acting as a hydraulic motor, acts to resist (or retard) the flow of fluid out of the head side chamber 32. If the displacement of the hydraulic pump 14 remains constant after the occurrence of the over-center load condition, the flow of fluid out of the head side chamber 32 at the same quantity as was flowing into the rod side chamber 30 prior to the over-center load condition results in an actuator velocity of one-half of the actuator velocity experienced prior to the over-center load condition due to the change in cross-sectional area. In this scenario, for the same pump displacement, the rate of change in volume of the head side chamber 32 is one-half the rate of change in volume of the rod side chamber 30. The velocity change at the actuator 24 is directly related to the ratio of the cross-sectional areas of the head side chamber 32 and the rod side chamber 30.

Figure 3:
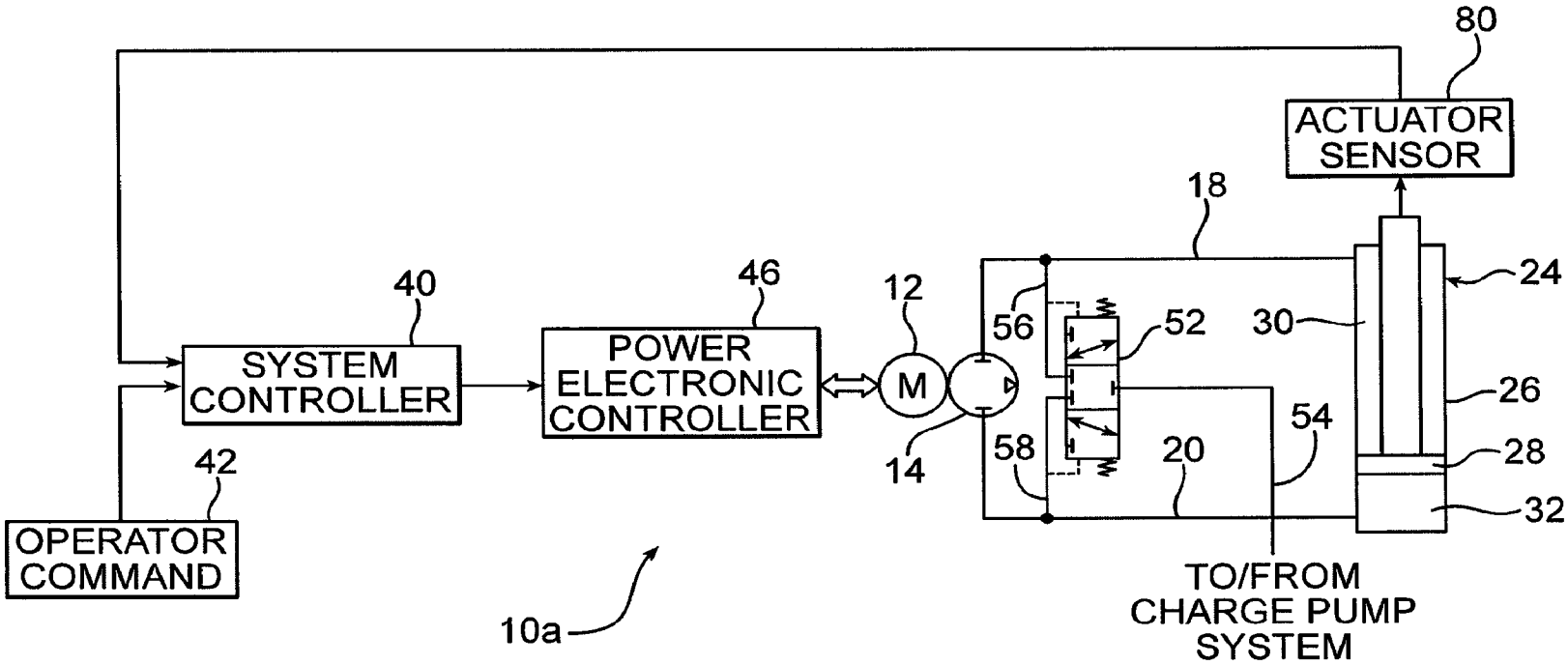
FIG. 3 illustrates a partial view of another exemplary embodiment of a system constructed in accordance with the present invention.

FIG. 3 illustrates a partial view of another exemplary embodiment of a system 10*a* constructed in accordance with the present invention. In FIG. 3, the structures that are the same as those described with reference to FIG. 1 are labeled with the same reference numbers and, if described previously, the description of those structures will be omitted. The system 10*a* of FIG. 3 acts to maintain a desired actuator velocity after the occurrence of an over-center load condition. The actuator position sensing device 80 senses the position of the piston relative to the housing 26 of the actuator 24 and provides feedback signals indicative of the sensed position to the system controller 40. The system controller 40 is responsive to the feedback signals for determining an actual velocity of the piston relative to the housing 26. The system controller 40 is responsive to the actual velocity for adjusting the desired velocity command signals provided to the power electronics controller 46 to maintain the velocity of the actuator 24 after the occurrence of the over-center load condition.

In an exemplary control scheme for the system 10*a* of FIG. 3, the actuator position sensing device 80 senses the position of the piston relative to the housing 26 at periodic intervals, such as once every 5 milliseconds, and provides a piston position feedback signal to the system controller 40 after each interval. The piston position feedback signal is conditioned as necessary and is used to determine a velocity of the piston relative to the housing 26, such as by the differential of the position over time. An error signal is determined by finding the difference between the actual velocity and the desired velocity and, the error signal is used to adjust the desired velocity command signals. For additional control, one may further use a PID (Proportional Integral Derivative) control scheme after adjusting the desired velocity command signal with the error signal. Upon the occurrence of an over-center load condition, a sudden change in the actuator velocity due to switching of the high pressure chamber results in a change in the determined actual velocity and thus, a change in the error signal. The error signal is used to adjust the desired velocity command signals to modify the speed of the electric motor 12 in an attempt to maintain the velocity of the actuator consistent with the velocity experienced immediately prior to the occurrence of the over-center load condition.

Figure 4:
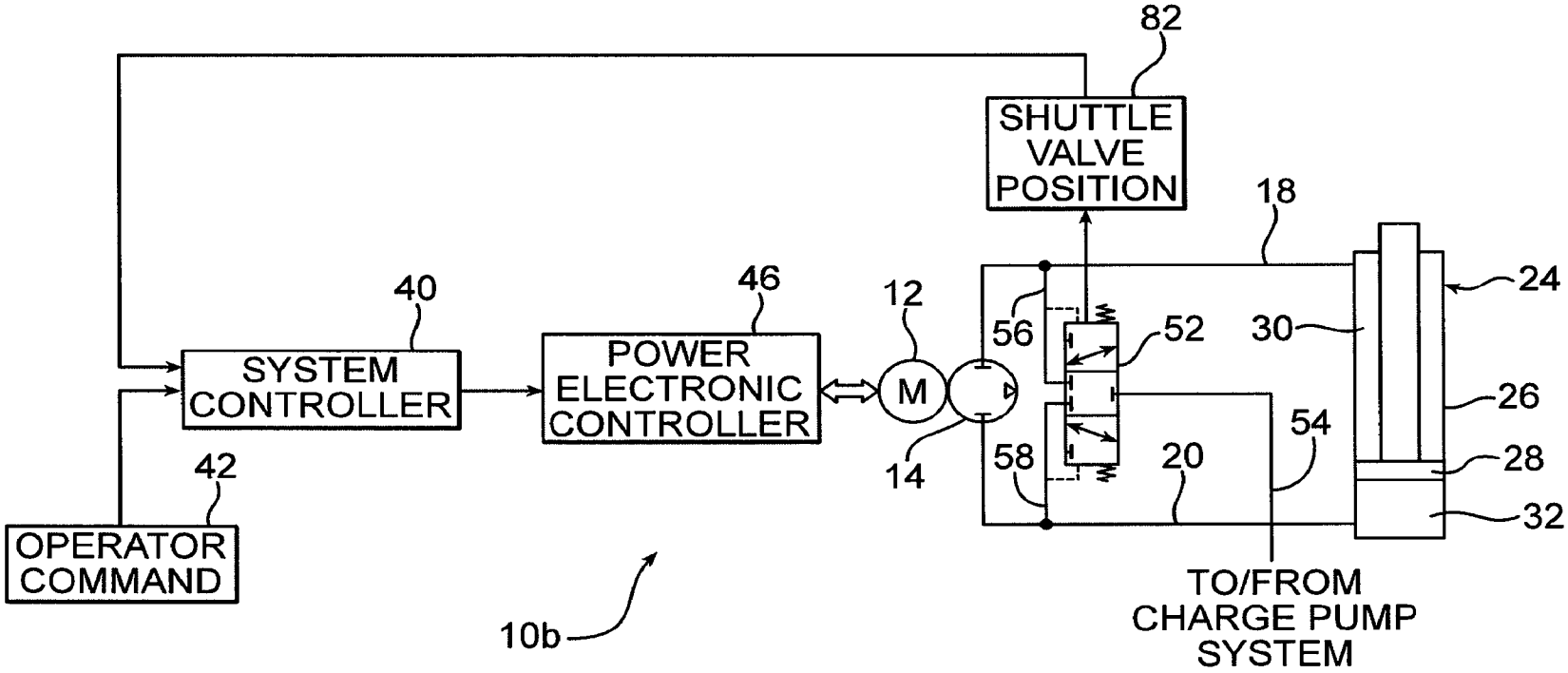
FIG. 4 illustrates a partial view of yet another exemplary embodiment of the present invention.

FIG. 4 illustrates a system 10*b* constructed in accordance with another embodiment of the present invention. In FIG. 4, the structures that are the same as those described with reference to FIG. 1 are labeled with the same reference numbers and, if described previously, the description of those structures will be omitted. In the system 10*b* of FIG. 4, the shuttle valve position sensing device 82 provides a feedback signal for helping the system controller 40 to maintain the velocity of the actuator in response to the occurrence of an over-center load condition.

As stated previously, the shuttle valve 52 automatically changes position in response to a pressure differential between the conduits 18 and 20 to connect the low pressure conduit to the charge pump system 50. With reference to FIG. 2(*a*), high pressure in conduit 18 forces the shuttle valve 52 downward, as viewed in FIG. 2(*a*), to the illustrated position. When the shuttle valve 52 is in the position illustrated in FIG. 2(*a*), fluid exiting the head side chamber 32 that is in excess of the fluid provided to the rod side chamber 30 is directed through the shuttle valve 52 and to the charge pump system 50 for return to the reservoir 66. FIG. 2(*b*) illustrates the system of FIG. 2(*a*) after the occurrence of an over-center load condition. When the load shifts direction at the occurrence of the over-center load condition, the high pressure chamber shifts to the head side chamber 32. As a result, the shuttle valve shifts 52 from the position illustrated in FIG. 2(*a*) to the position illustrated in FIG. 2(*b*).

After the occurrence of an over-center load condition, if the electric motor 12 speed is kept constant (i.e., pump displacement also remains constant), there will be an undesired change in velocity, as described above. Upon the occurrence of the over-center load condition, however, the shuttle valve 52 shifts position to connect the charge pump system 50 to the low pressure conduit. The system 10*b* of FIG. 4 senses the shifting of the position of the shuttle valve 52 and is responsive to the sensed shift for adjusting the speed of the electric motor 12 and thus, the pump 14 displacement, for attempting to maintain the velocity of the actuator 24. The shuttle valve position sensing device 82 is adapted to sense the position of the shuttle valve 52 at regular intervals and to provide feedback signals indicative of the sensed shuttle valve 52 position to the system controller 40. The system controller 40 is responsive to receiving the feedback signal from the shuttle valve position sensing device 82 for modifying the speed of the electric motor 12.

Figure 5:
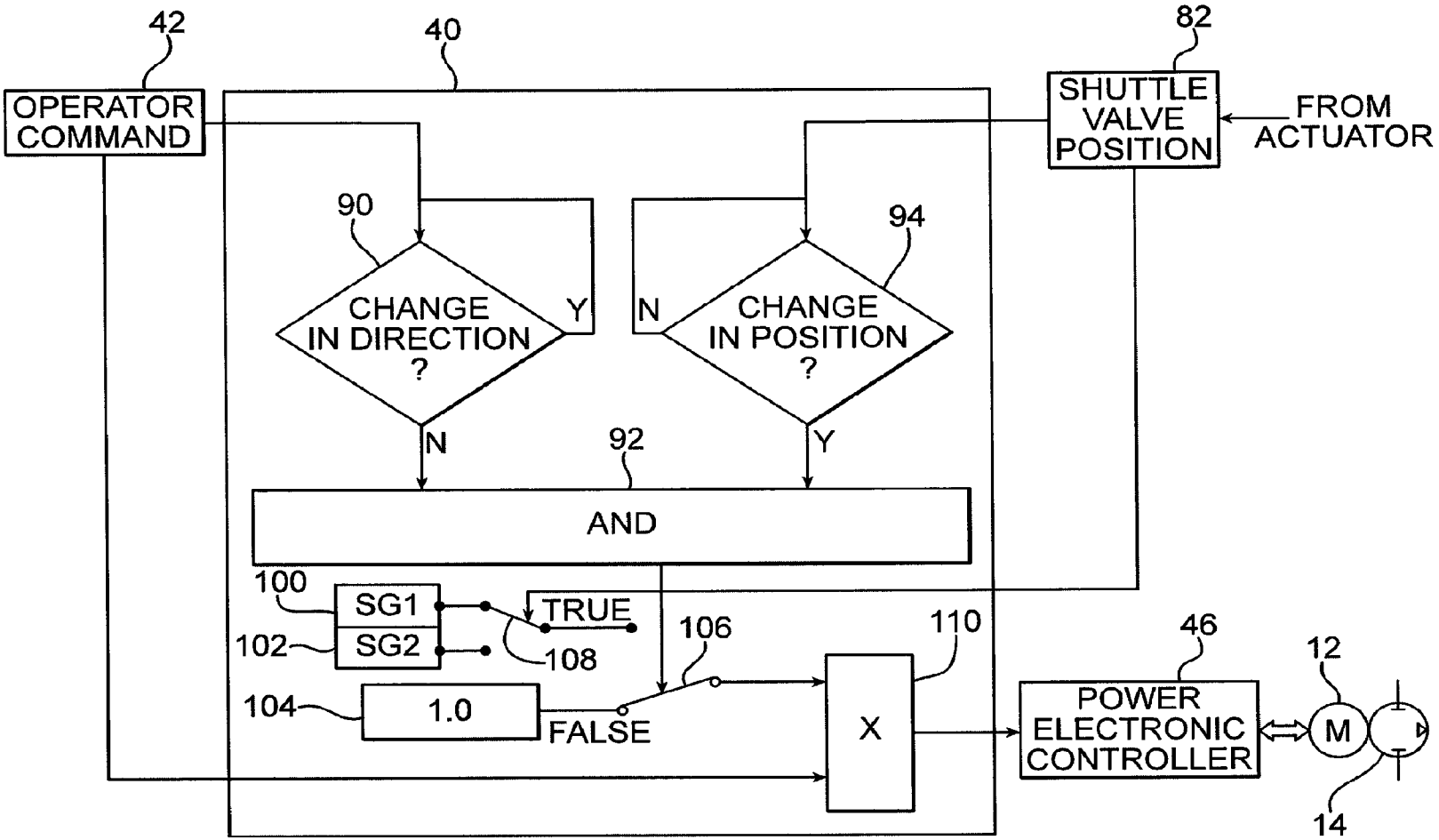
FIG. 5 is an exemplary control schematic for the system of FIG. 4.

FIG. 5 is an exemplary control schematic for the system of FIG. 4. In FIG. 5, an input signal output by the operator input device 42 is provided to the system controller 40. The input signal indicates a desired velocity of the actuator 24 and thus, includes a speed component and a direction component. The system controller 40 conditions the input signal as necessary and provides the direction component of the input signal to a desired direction determination function, illustrated schematically at 90 in FIG. 5. The desired direction determination function 90 receives the direction component of the input signal at regular intervals. The desired direction determination function 90 compares each received direction component with the preceding received direction component to determine whether the input signal has requested a change in direction. When no change in direction is determined, the desired direction determination function 90 outputs a TRUE signal to a logical conjunction (AND) function, illustrated schematically at 92 in FIG. 5. When a change in direction is determined, the desired direction determination function 90 outputs a FALSE signal to a logical conjunction function 92 of the system controller 40.

The system controller 40 also includes a shuttle valve position determination function, illustrated schematically at 94 in FIG. 5. The shuttle valve position determination function 94 receives the shuttle valve position feedback signal at regular intervals from the shuttle valve position sensing device 82. The shuttle valve position determination function 94 compares each received shuttle valve position feedback signal with the preceding received shuttle valve position feedback signal to determine whether the shuttle valve 52 has shifted position. When a shift in position is determined, the shuttle valve position determination function 94 outputs a TRUE signal to the logical conjunction function 92. When no shift in position is determined, the shuttle valve position determination function 94 outputs a FALSE signal to a logical conjunction function 92.

The logical conjunction function 92 evaluates the signals received from the desired direction determination function 90 and the shuttle valve position determination function 92. When an over-center load condition occurs, the signals from both the desired direction determination function 90 and the shuttle valve position determination function 92 are TRUE. If one of the signals from the desired direction determination function 90 and the shuttle valve position determination function 92 is FALSE, an event other than an over-center load condition has occurred, such as, e.g., a requested change of direction by the operator. The logical conjunction function 92 outputs a gain signal for controlling a gain function of the system controller 40 in response to determining whether an over-center load condition has occurred. In FIG. 5, the gain function is illustrated by a first, second and third gain values 100, 102, and 104, respectively, and two switches 106 and 108 that are controllable for outputting one of the first, second and third gain values. Switch 106 is controlled by the gain signal output from the logical conjunction function 92. When the logical conjunction function 92 determines that an over-center load condition has occurred (i.e., a TRUE determination), switch 106 is positioned to be connected with one of the first and second gain values 100 and 102. When the logical conjunction function 92 determines that no over-center load condition has occurred (i.e., a FALSE determination), switch 106 is positioned to connect with the third gain value, as is shown in FIG. 5. The third gain value 104 is equal to one. Switch 108 is controlled by the shuttle valve position sensing device 82. When the shuttle valve position sensing device 82 determines that the shuttle valve 52 is in a first position, such as the position illustrated in FIG. 2(*a*), switch 108 is positioned to connect with the first gain value 100. When the shuttle valve position sensing device 82 determines that the shuttle valve 52 is in a second position, such as the position illustrated in FIG. 2(*b*), switch 108 is positioned to connect with the second gain value 102. The first and second gain values 100 and 102 may be calculated and are a function of the cross-sectional areas of the rod side chamber 30 and head side chamber 32 of the actuator 24.

Depending upon the position of the switches 106 and 108, one of the first, second, and third gain values 100, 102, or 104 is provided to a multiplication function 110 of the system controller 40. The input signal from the operator input device 42 also is provided to the multiplication function 110. The multiplication function 110 operates to multiply the speed component of the input signal by the received gain value 100, 102, or 104 and to output the desired velocity command signals to the power electronics controller 46 for controlling the speed and direction of the electric motor 12 and thus, the pump 14 displacement. When an over-center load condition is determined by the logical conjunction function 92, the system controller 40 modifies the desired velocity command signals based upon the selected first or second gain value 100 or 102 to modify the electric motor 12 speed. If, for example, the shuttle valve 52 shifts from the position illustrated in FIG. 2(*a*) to the position illustrated in FIG. 2(*b*), the system controller 40 modifies the desired velocity command signal to increase the speed of the electric motor 12 to increase the displacement of the pump 14. If, on the other hand, the shuttle valve 52 shifts from the position illustrated in FIG. 2(*b*) to the position illustrated in FIG. 2(*a*), the system controller 40 modifies the desired velocity command signal to decrease the speed of the electric motor 12 to decrease the displacement of the pump 14. When no over-center load condition is determined, the system controller 40 does not modify the desired velocity command signals (i.e., the third gain value 104 equals one).

Figure 6:
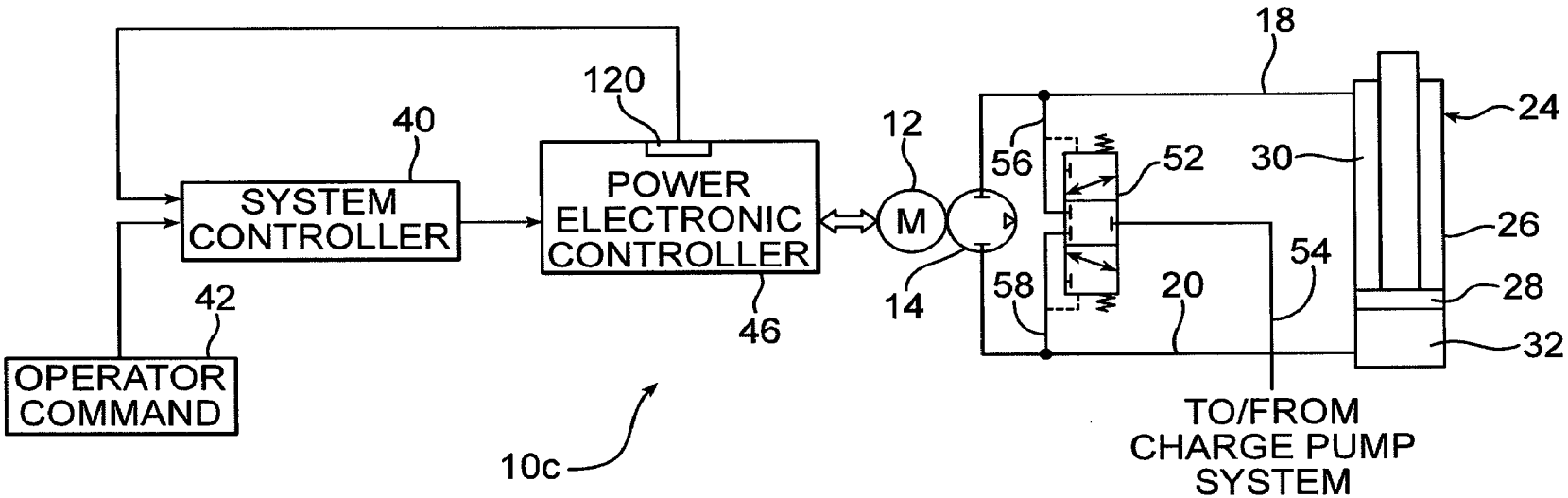
FIG. 6 illustrates a partial view of still another exemplary embodiment of a system constructed in accordance with the present invention.

FIG. 6 illustrates a system 10*c* constructed in accordance with yet another embodiment of the present invention. In FIG. 6, the structures that are the same as those described with reference to FIG. 1 are labeled with the same reference numbers and, if described previously, the description of those structures will be omitted. The system 10*c* of FIG. 6 also attempts to maintain a velocity of the actuator in response to the occurrence of an over-center load condition.

In the system 10*c* of FIG. 6, the power electronics controller 46, or alternatively the electric motor 12, or both, has a feedback device 120 for outputting a feedback signal indicative of the electric current and the speed of the electric motor 12. FIG. 6 illustrates the power electronics controller 46 having the current and speed feedback device 120. The speed of the electric motor 12 can, for example, be obtained through resolvers, encoders or software calculations if a sensor-less electric motor is employed. Electric current typically is available within the power electronics controller 46 through output current measurements probes. The speed and current feedback signal is provided to the system controller 40, which utilizes the feedback signal to attempt to maintain a velocity of the actuator in response to the occurrence of an over-center load condition.

Figure 7:
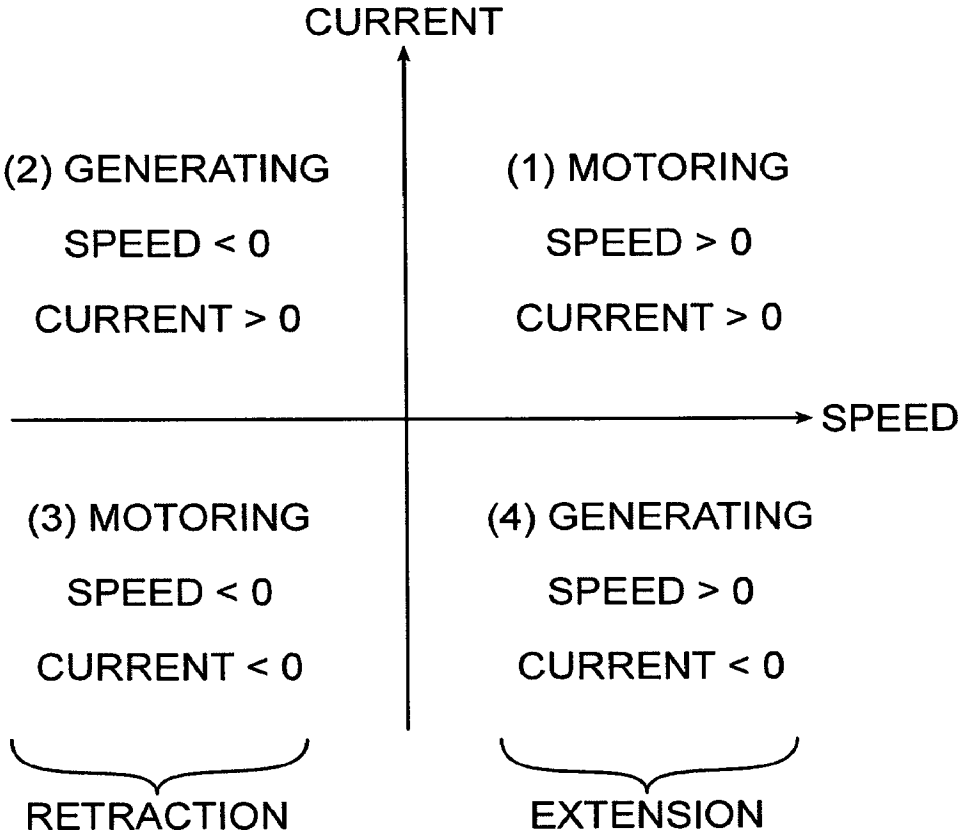
FIG. 7 illustrates four-quadrant operation of an electric motor during motion of an actuator of an EHA system.

FIG. 7 illustrates four-quadrant operation of an electric motor 12 during movement of an actuator 24 with the speed of the electric motor 12 on an X-axis and the electric current draw of the electric motor 12 on the Y-axis. In FIG. 7, a positive speed of the electric motor 12 results in motion of the actuator 24 in the extension direction and a negative speed results in motion of the actuator 24 in the retraction direction. During motion in the extension direction, a positive speed and a positive current draw (quadrant (1)) is indicative of a motoring mode of the electric motor 12 (i.e., the electric motor consumes energy), while during motion in the retraction direction, a negative speed and a negative current draw (quadrant (3)) is indicative of a motoring mode of the electric motor 12. The electric motor 12 is in the motoring mode when the high pressure chamber of the actuator 24 is expanding in volume, for example, the rod side chamber 30 of FIG. 2(*a*). The electric motor 12 also has a generating mode in which the electric motor produces energy. The generating mode occurs when the high pressure chamber of the actuator 24 is decreasing in volume, for example, the head side chamber 32 of FIG. 2(*b*), and the hydraulic pump 14 acts to as a motor to control the flow of fluid out of the high pressure chamber. When the hydraulic pump 14 acts as a motor, the electric motor 12 is rotated by the pump and electric energy is produced. During motion in the extension direction, a positive speed and a negative current draw (quadrant (4)) is indicative of a generating mode, while during motion in the retraction direction, a negative speed and a positive current draw (quadrant (2)) is indicative of a generating mode.

The system 10*c* of FIG. 6 uses the speed and current information provided in the speed and current feedback signal to detect the occurrence of an over-center load condition. As discussed previously with reference to FIGS. 2(*a*) and 2(*b*), the high pressure chamber of the actuator 24 changes from (i) the rod side chamber 30 to the head side chamber 32, or (ii) from the head side chamber 32 to the rod side chamber 30 during motion in the same direction upon the occurrence of an over-center load condition. This change results in the electric motor 12 switching from (i) a motoring mode to a generating mode, or (ii) from a generating mode to a motoring mode. Thus, a change in the sign of the current from (i) positive to negative, or (ii) negative to positive without a change in the direction of the speed is indicative of the occurrence of an over-center load condition. The system controller 40 is responsive to the speed and current feedback signal indicating the occurrence of an over-center load condition for modifying the speed of the electric motor 12 to attempt to maintain a velocity of the actuator in response to the occurrence of an over-center load condition.

Figure 8:
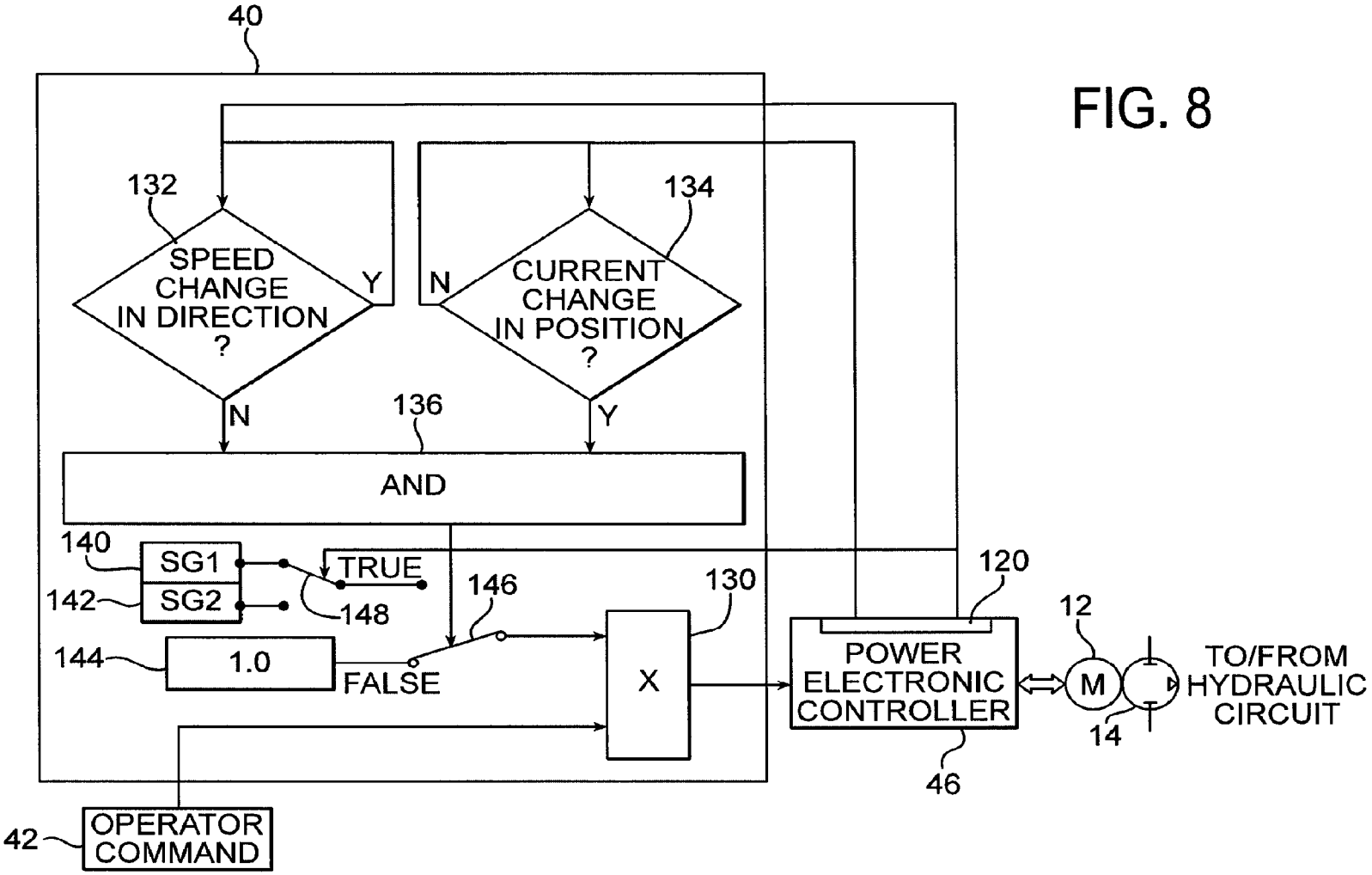
FIG. 8 is an exemplary control schematic for the system of FIG. 6.

FIG. 8 is an exemplary control schematic for the system 10*c* of FIG. 6. In FIG. 8, an input signal output by the operator input device 42 is provided to the system controller 40. The input signal indicates a desired velocity of the actuator 24 and thus, includes a speed component and a direction component. The system controller 40 conditions the input signal as necessary and provides the input signal a multiplication function 130. The system controller 40 also receives the feedback signal from the current and speed feedback device, conditions the feedback signal as necessary, and provides the speed component to a direction determination function, illustrated schematically at 132 in FIG. 8, and provides the current component to a current sign determination function, illustrated schematically at 134 in FIG. 8.

The direction determination function 132 receives the speed component at regular intervals. The direction determination function 132 compares the sign of each received speed component with the sign of the preceding received speed component to determine whether the motor has changed direction, i.e., determine whether there was a change of the sign of the speed component from positive to negative or from negative to positive. When no change in direction is determined, the direction determination function 132 outputs a TRUE signal to a logical conjunction (AND) function, illustrated schematically at 136 in FIG. 8. When a change in direction is determined, the direction determination function 132 outputs a FALSE signal to a logical conjunction function 136.

The current sign determination function 134 receives the current component of the feedback signal at regular intervals. The current sign determination function 134 compares the sign of each received current component with the sign of the preceding received current component to determine whether the electric motor 12 has shifted between motoring and generating modes. When a shift in modes is determined, the current sign determination function 134 outputs a TRUE signal to the logical conjunction function 136. When no shift in modes is determined, the current sign determination function 134 outputs a FALSE signal to the logical conjunction function 136.

The logical conjunction function 136 evaluates the signals received from the direction determination function 132 and the current sign determination function 134. When an over-center load condition occurs, the signals from both the direction determination function 132 and the current sign determination function 134 are TRUE. If one of the signals from the direction determination function 132 and the current sign determination function 134 is FALSE, an event other than an over-center load condition occurred, such as, e.g., a requested change of direction by the operator. The logical conjunction function 136 outputs a gain signal for controlling a gain function of the system controller 40 in response to determining whether an over-center load condition has occurred.

In FIG. 8, the gain function is illustrated by a first, second and third gain values 140, 142, and 144 and two switches 146 and 148 that are controllable for outputting one of the first, second and third gain values. Switch 146 is controlled by the gain signal output from the logical conjunction function 136. When the logical conjunction function 136 determines that an over-center load condition has occurred (i.e., a TRUE determination), switch 146 is positioned to be connected with one of the first and second gain values 140 and 142. When the logical conjunction function 136 determines that no over-center load condition has occurred (i.e., a FALSE determination), switch 146 is positioned to connect with the third gain value 144, as is shown in FIG. 8. The third gain value 144 is equal to one. Switch 148 is controlled by the speed component of the feedback device 120. When the feedback device 120 determines that the sign of the speed is positive (motion in the extension direction per FIG. 7), switch 148 is positioned to connect with the first gain value 140. When the feedback device 120 determines that the sign of the speed is negative (motion in the retraction direction per FIG. 7), switch 148 is positioned to connect with the second gain value 142. The first and second gain values 140 and 142 may be calculated and are a function of the cross-sectional areas of the rod side chamber 30 and head side chamber 32 of the actuator 24.

Depending upon the position of the switches 146 and 148, one of the first, second, and third gain values 140, 142, and 144 is provided to the multiplication function 130 of the system controller 40. The input signal also is provided to the multiplication function 130 of the system controller 40. The multiplication function 130 operates to multiply the speed component of the input signal by the gain signal and to output a desired velocity command signal to the power electronics controller 46 for controlling the electric motor 12 and thus, the pump 14 displacement. When an over-center load condition is determined to have occurred by the logical conjunction function 136, the system controller 40 modifies the desired velocity command signal to the power electronics controller 46 to modify the speed of the electric motor 12 in an attempt to maintain the velocity of the actuator 24. When a determination is made that no over-center load condition has occurred, the system controller 40 does not modify the desired velocity command signals (i.e., the third gain value 144 equals one).

Each of the systems described herein have an electric motor 12 that is controlled for attempting to maintain a desired actuator velocity when the actuator is subjected to an over-center load condition. The systems each include one or more devices for detecting a condition that is indicative of the occurrence of an over-center load condition and for providing feedback signals to a controller 40 for adjusting a speed of the electric motor 12 in response to such a determination.

Although the principles, embodiments and operation of the present invention have been described in detail herein, this is not to be construed as being limited to the particular illustrative forms disclosed. It will thus become apparent to those skilled in the art that various modifications of the embodiments herein described may be made without departing from the scope of the invention.

What is claimed is:

1. An electro-hydraulic actuation system comprising:

an unbalanced hydraulic actuator capable of motion in retraction and extension directions during movement of a load;

a pump for providing a flow of fluid to the actuator, a fluid volume output of the pump controlling a velocity of the actuator during motion in the retraction and extension directions;

an electric motor for driving the pump, speed and direction of the electric motor affecting the fluid volume output of the pump;

a controller for controlling the speed and direction of the electric motor; and a feedback device operable for sensing a system condition and for providing a feedback signal indicative of the sensed system condition to the controller, the controller being responsive to the feedback signal for determining an occurrence of an over-center load condition and for modifying the speed of the electric motor in response to the occurrence in an attempt to maintain the velocity of the actuator;

wherein the feedback device is adapted to sense current and direction of rotation of the electric motor; and wherein the controller determines the occurrence of an over-center load condition when a sign of the current changes while a direction of rotation of the electric motor remains unchanged.

2. The electro-hydraulic actuation system of claim 1 wherein the electric motor is a variable speed motor and the pump is a fixed displacement pump, the fluid volume output of the pump being dependent upon the speed of the electric motor.

3. The electro-hydraulic actuation system of claim 1 wherein the actuator includes a first chamber and a second chamber, during motion in the retraction and extension directions one of the first and second chambers being a high pressure chamber, upon the occurrence of an over-center load condition the high pressure chamber switching to the other of the first and second chambers.

4. The electro-hydraulic actuation system of claim 1 wherein the feedback device is adapted to sense one of a position or velocity of a piston of the actuator relative to a housing of the actuator.

5. The electro-hydraulic actuation system of claim 4 including an actuator position sensing device that is adapted to sense a position of the piston relative to the housing and to provide feedback signals to the system controller at regular intervals, the system controller determining the velocity of the actuator from the feedback signals.

6. The electro-hydraulic actuation system of claim 5 wherein the system controller also receives input signals indicative of a desired actuator velocity from an operator input device, the system controller being responsive to a difference between the desired actuator velocity and the determined actuator velocity for modifying the speed of the electric motor.

7. The electro-hydraulic actuation system of claim 1 wherein the actuator includes a piston/rod assembly that divides the actuator into first and second chambers and moves relative to a housing of the actuator during motion in the retraction and extension directions, one of the first and second chambers being a high pressure chamber during movement of the piston/rod assembly relative to the housing, upon the occurrence of an over-center load condition the high pressure chamber switching to the other of the first and second chambers, the feedback device being responsive to the switching of the high pressure chamber for providing the feedback signal to the controller.

8. The electro-hydraulic actuation system of claim 7 wherein the system further including a charge pump system, a shuttle valve that is responsive to a pressure differential between the first and second conduits for connecting the charge pump system in fluid communication with one of the first and second chambers, upon the occurrence of an over-center load condition the shuttle valve switching positions to connect the charge pump system in fluid communication with the other of the first and second chambers, the feedback device being adapted to sense a position of the shuttle valve.

9. The electro-hydraulic actuation system of claim 1 wherein the feedback device is located in one of the electric motor or a power electronic controller associated with the electric motor.

10. The electro-hydraulic actuation system of claim 1 wherein the system controller receives input signals indicative of a desired actuator velocity from an operator input device and is responsive to the signals for outputting desired velocity command signals, the controller including a gain function having first and second gain values, the controller modifying the desired velocity command signals by the first gain value when the sign of the current changes from positive to negative and modifying the desired velocity command signals by the second gain value when the sign of the current changes from negative to positive.

11. The electro-hydraulic actuation system of claim 10 wherein the first and second gain values are dependent upon a ratio of the cross-sectional areas of the first and second chambers of the actuator.

12. The electro-hydraulic actuation system comprising:

an unbalanced hydraulic actuator capable of motion in retraction and extension directions during movement of a load;

a pump for providing a flow of fluid to the actuator, a fluid volume output of the pump controlling a velocity of the actuator during motion in the retraction and extension directions;

an electric motor for driving the pump, speed and direction of the electric motor affecting the fluid volume output of the pump;

a controller for controlling the speed and direction of the electric motor; and a feedback device operable for sensing a system condition and for providing a feedback signal indicative of the sensed system condition to the controller, the controller being responsive to the feedback signal for determining an occurrence of an over-center load condition and for modifying the speed of the electric motor in response to the occurrence in an attempt to maintain the velocity of the actuator;

wherein the actuator includes a piston/rod assembly that divides the actuator into first and second chambers and moves relative to a housing of the actuator during motion in the retraction and extension directions, one of the first and second chambers being a high pressure chamber during movement of the piston/rod assembly relative to the housing, upon the occurrence of an over-center load condition the high pressure chamber switching to the other of the first and second chambers, the feedback device being responsive to the switching of the high pressure chamber for providing the feedback signal to the controller;

wherein the system further includes a charge pump system, a shuttle valve that is responsive to a pressure differential between the first and second conduits for connecting the charge pump system in fluid communication with one of the first and second chambers, upon the occurrence of an over-center load condition the shuttle valve switching positions to connect the charge pump system in fluid communication with the other of the first and second chambers, the feedback device being adapted to sense a position of the shuttle valve; and wherein the controller determines the occurrence of an over-center load condition when a direction of movement of the piston/rod assembly relative to the housing remains unchanged when the valve shifts positions.

13. The electro-hydraulic actuation system of claim 12 wherein the system controller receives input signals indicative of a desired actuator velocity from an operator input device and is responsive to the input signals for outputting desired velocity command signals, the controller including a gain function having first and second gain values, the controller modifying the desired velocity command signals by the first gain value when the high pressure chamber switches from the first chamber to the second chamber and modifying the desired velocity command signals by the second gain value when the high pressure chamber switches from the second chamber to the first chamber.

14. The electro-hydraulic actuation system of claim 13 wherein the first and second gain values are dependent upon a ratio of the cross-sectional areas of the first and second chambers of the actuator.

15. The electro-hydraulic actuation system of claim 12 wherein the electric motor is a variable speed motor and the pump is a fixed displacement pump, the fluid volume output of the pump being dependent upon the speed of the electric motor.

16. The electro-hydraulic actuation system of claim 12 wherein the feedback device is adapted to sense one of a position or velocity of a piston of the actuator relative to a housing of the actuator.

17. The electro-hydraulic actuation system of claim 16 including an actuator position sensing device that is adapted to sense a position of the piston relative to the housing and to provide feedback signals to the system controller at regular intervals, the system controller determining the velocity of the actuator from the feedback signals.

18. The electro-hydraulic actuation system of claim 12 wherein the feedback device is adapted to sense current and direction of rotation of the electric motor.

* * * * *